United States Patent [19]

Means et al.

[11] 3,948,182

[45] Apr. 6, 1976

[54] SEMI-ACTIVE ELECTRO-OPTICAL BOMBLET FUZE

[75] Inventors: James E. Means, Corona; Matthew E. Anderson, Ontario, both of Calif.

[73] Assignee: The United States of America as represented by the Secretary of the Navy, Washington, D.C.

[22] Filed: Oct. 3, 1968

[21] Appl. No.: 766,035

[52] U.S. Cl. ..... 102/70.2 P

[51] Int. Cl.[2] ..... F42C 13/02

[58] Field of Search ..... 102/70.2, 70.2 P, 79, 80

[56] References Cited

UNITED STATES PATENTS 2,927,213 3/1960 Marion et al. ..... 102/70.2 P 3,485,461 12/1969 Katsanis ..... 102/70.2

*Primary Examiner*—Verlin R. Pendegrass

*Attorney, Agent, or Firm*—Richard S. Sciascia; J. M. St. Amand

[57] ABSTRACT

A pressure-armed, semiactive bomblet fuze, having both contact and proximity-fuze capability for a free-fall weapon, and utilizing both a gyro aligning fuze train and a photocell transducer for directly initiating an electric detonator.

8 Claims, 4 Drawing Figures

JAMES E. MEANS
MATHEW E. ANDERSON
*INVENTORS*

BY J. M. St. Amand

SEMI-ACTIVE ELECTRO-OPTICAL BOMBLET FUZE

The invention herein described may be manufactured and used by or for the Government of the United States of America for governmental purposes without the payment of any royalties thereon or therefor.

This invention is related to U.S. patent application Ser. No. 765,749 filed Oct. 3, 1968 for Optical Semiactive Bomblet Fuze.

Prior electronic bomblet proximity fuzes are expensive, complex, require batteries and are subject to countermeasures and prefire from crosstalk between other bomblets and canopy over a target.

The present semiactive electro-optical fuze is immune to electronic countermeasures, thus avoiding canopy prefires, as well as prefires caused by crosstalk between bomblets. Also, since this fuze does not require a battery type power supply storage and temperature requirements of batteries have been eliminated.

The present fuze utilizes a photocell type of sensor, for example, for directly initiating an electrically initiated detonator. The photocell sensor is matched to the wavelength of certain flash charges and high intensity energy in light from pyrotechnic sources to generate power for initiating the detonator.

Other objects and many of the attendant advantages of this invention will become readily appreciated as the same becomes better understood by reference to the following detailed description when considered in connection with the accompanying drawings wherein.

Referring now to the drawings like numerals refer to like parts in each of the figures.

Figure 1:
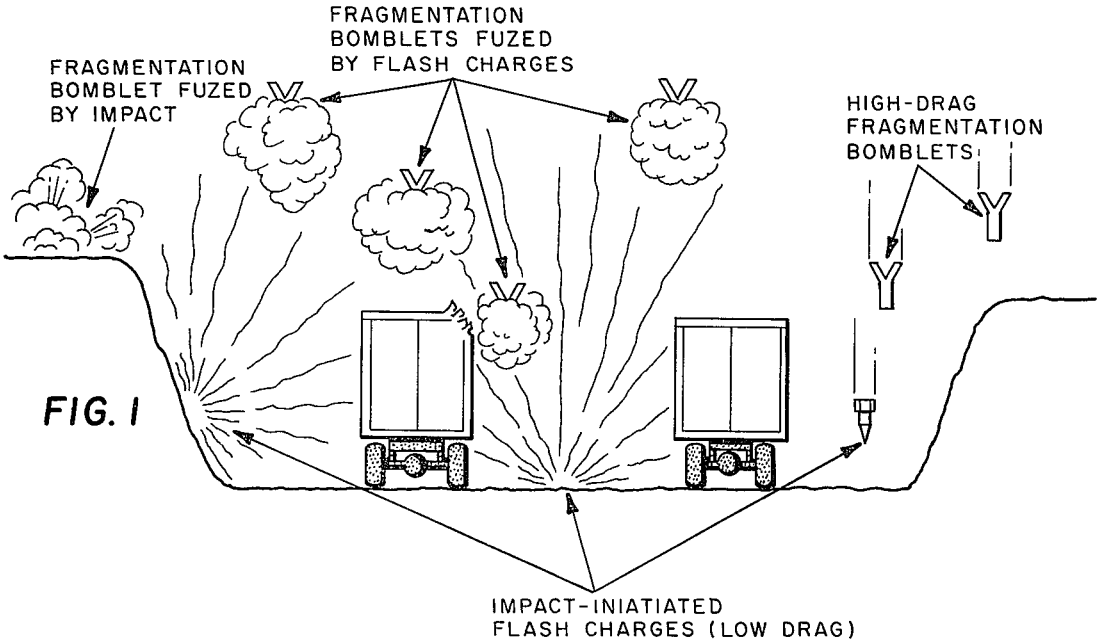
FIG. 1 illustrates one concept of a flash-initiated proximity fuze.

One method for the deployment of bomblets consists in loading a warhead canister with two types of submunitions — a small number of low-drag initiator bomblets filled with a material, such as a magnesium-sodium nitrate, for example, that will, upon impact with the ground or target, emit a high-intensity pulse of energy with a band of particular wavelength, and a large number of high-drag bomblets that constitute the payload. Each payload bomblet is equipped with a proximity fuze, hereinafter described, whose sensor is matched to the wavelength of the pulse of energy emitted from the ground burst of the initiator bomblets. The two types of bomblets have a difference in their drag coefficients to result in an approximately constant height of burst for the payload bomblets over a given range of launch velocities. This concept is illustrated by FIG. 1 which shows impact-initiated flash charges from the low-drag initiator bomblets resulting in detonation of the fragmentation payload bomblets above the targets. The payload bomblets can also be detonated by contact.

Figure 2:
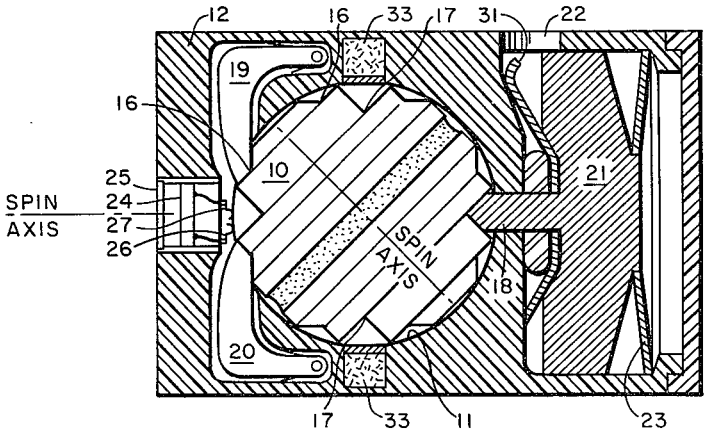
FIG. 2 shows one embodiment of a fuze of the invention in safe position, partially in cross-section along its spin-axis.

A preferred type of fuze for use in the payload bomblets is shown in FIGS. 2 and 3 and hereinafter described. Fuzes of the present invention would normally be employed in bomblets such that the spin axes of both fuze and bomblets are coincident.

Figure 3A:
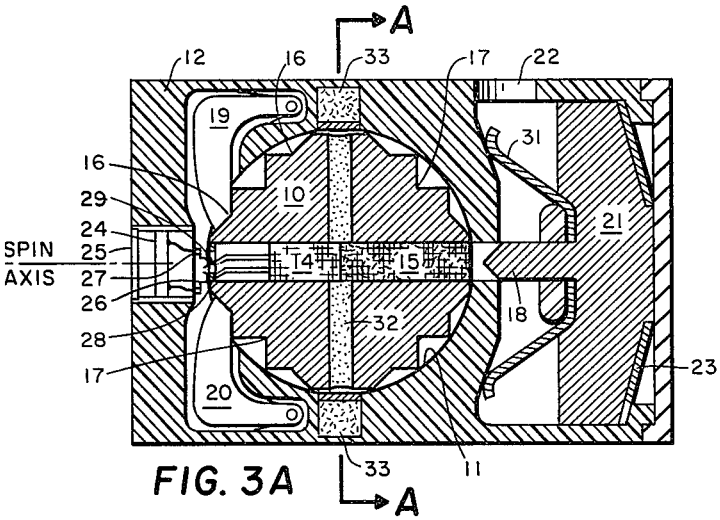
FIG. 3A shows the fuze of FIG. 2 in armed position.
Figure 3B:
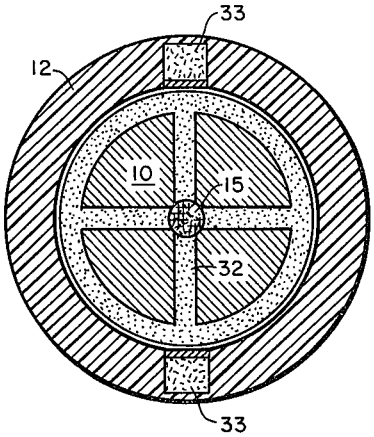
FIG. 3B is a cross-sectional view taken along line A—A of FIG. 3A.

A spin-and-pressure armed bomblet fuze that utilizes a photocell transducer for directly initiating an electrical detonator is shown in FIGS. 2, 3A and 3B. This fuze has a firing train aligning gyro rotor 10 within a spherical chamber 11 in fuze housing 12. Two detonators 14 and 15 are contained within gyro rotor 10 along the spin-axis thereof. Detonator 14 is electrically initiated and detonator 15 is stab-sensitive.

Gyro-rotor 10 is maintained in the safe position, as shown in FIG. 2 by a stab-detent 18 and two centrifugally operated spring locking weights 19 and 20. High-pressure gas applied to the fuze through pressure access hole 22 (after safe separation of the bomblet from a launch vehicle) forces inertial weight 21 against a Belleville type spring 23, for example, and causes it to toggle over to a position, as shown in FIG. 3A. When the bomblet containing the fuze reaches a minimum spin speed after dispersal, locking weights 19 and 20 are moved by centrifugal force permitting gyrorotor 10 to rotate within spherical chamber 11 and with respect to the fuze housing 12 to align its spin-axis with the spin axis of the fuze, and in turn align the explosive train to the armed position of FIG. 3A. When the spin of the bomblet containing the fuze is decreased, upon deployment of a drogue for example, locking weights 19 and 20 return to their original position locking gyro-rotor 10 in the armed position.

A photocell transducer 24, such as a silicon photocell type of sensor for example, is mounted along the fuze spin-axis in the forward end of fuze housing 12. A window or a wavelength filter 25 may be positioned in front of photocell 24 as desired. Photocell 24 is electrically connected between a pair of electrical spring contacts 26 and 27 mounted behind the photocell and which extend slightly into spherical chamber 11. Electrically initiated detonator 14 which is mounted within gyro rotor 10 along the rotor spin-axis has a ring shaped contact 28 and a central contact 29, for example, that make electrical contact with spring contacts 26 and 27, respectively, when the fuze is armed.

When the fuze is armed and the gyro rotor spin-axis is aligned with the fuze spin-axis, the explosive train consists of electrically initiated detonator 14 electrically connected to photocell 24 in the forward end of the fuze housing, and stab-sensitive detonator 15 in the opposite end of rotor 10 aligned with inertially actuated stab-detent 18. Stab-detent 18, which extends from inertial weight 21 is held back by leaf spring 31 after arming, acts as a backup for end-on impacts with a target or the ground. As shown in the position of FIG. 3A, inertial weight 21 is in position to force stab-detent 18 forward to actuate stab-sensitive detonator 15 upon impact. The explosive output from both detonators 14 and 15 goes to torriodal explosive lead 32, FIG. 3B, then to output explosive leads 33 and the main bomblet explosive.

The arming spin rate can be controlled by torsion springs on centrifugally operated spring locking weights 19 and 20. There is no stored energy in this fuze that could accidentally drive rotor 10 toward the armed condition.

Obviously many modifications and variations of the present invention are possible in the light of the above teachings. It is therefore to be understood that within the scope of the appended claims the invention may be practiced otherwise than as specifically described.

What is claimed is:

1. A fuze system for free-fall weapons, comprising:

a. A fuze, for fragmentation free-fall weapon, having contact and proximity fuze capabilities, said proximity fuze capability operable to be initiated from electromagnetic radiation of select bandwith, b. at least one impact-initiated source of electromagnetic radiation of select bandwidth separate and apart from said fuze, for initiating the proximity fuze capability of said fuze, c. said fuze comprising a cylindrical fuze housing whose spin axis coincides with the cylinder axis, d. a spherical chamber in a forward portion of said housing along said spin axis, e. an opening between the forward end of said housing and said spherical chamber, f. an electromagnetic radiation receiver means mounted in said opening and operable to generate an electrical pulse upon receiving electromagnetic radiation of select bandwidth from said impact initiated source of electromagnetic radiation.

g. a first pair of electrical contacts connected to said electromagnetic radiation receiver means, h. a gyro rotor having a diameter slightly less than the diameter of said spherical chamber and operable to slideably rotate therein to align its spin axis with the spin axis of said fuze housing, i. a passage through said rotor along its spin axis, j. an electrically initiated explosive detonator contained in said rotor passage at its forward end, k. a second pair of electrical contacts connected to said electrically initiated explosive detonator for making electrical contact with said first pair of electrical contacts when the spin axes of said rotor and fuze housing are aligned, thus completing an electrical circuit between said electromagnetic radiation receiver means and said electrically initiated detonator, l. an inertially actuated stab-detent means mounted in a rearward portion of said fuze housing, m. a stab-sensitive explosive detonator contained in said rotor passage at its rearward end, n. an output explosive lead between said spherical chamber and the outer wall of said fuze housing, o. a torroidal explosive lead leading from said electrically initiated explosive detonator and from said stab-sensitive explosive detonator to the outer periphery of said rotor and which completes an explosive train between said detonators and said output explosive lead when said rotor spin axis is aligned with the fuze housing spin axis, p. locking means for locking said rotor in safe position with its spin axis out of alignment with the fuze housing spin axis, q. said locking means operable to release said rotor when said fuze is rotated about its spin axis at a certain minimum speed following safe separation of a weapon containing the fuze from a launch vehicle allowing said rotor to rotate and move to armed position aligning its spin axis with that of said fuze, thus aligning said electrically initiated explosive detonator into electrical contact with said electromagnetic radiation receiver means and said stab-sensitive explosive detonator with said stab detent means and then locking said rotor in armed position when the rotation of said fuze about its spin axis is reduced below said minimum speed, wherein when in armed position a concentration of electromagnetic radiation of proper bandwidth detected by said electromagnetic radiation receiver means will result in detonation thereof and wherein head-on impact will cause said stab-detent means to stab said stab-sensitive explosive detonator resulting in detonation thereof.

2. A proximity fuze as in claim 1 wherein in addition to said locking means said rotor is initially also maintained in safe position by said stab-detent means which is actuated by an actuating means to release said rotor following safe separation of the fuze from the launch vehicle.

3. A fuze as in claim 1 wherein said stab-detent means extends from a piston shaped inertial weight which forces said stab-detent forward upon head-on impact.

4. A fuze as in claim 1 wherein said locking means include spring means which are centrifugally operated and said minimum speed for allowing arming is controlled by said spring means.

5. A fuze system as in claim 1 wherein said at least one electromagnetic radiation source is provided by at least one impact-initiated electromagnetic radiation means which is launched from said launch vehicle with the weapon containing said fuze.

6. A fuze as in claim 1 wherein a light wavelength filter is provided in said opening in the forward end of the fuze housing forward of said electromagnetic radiation receiver means.

7. A fuze system as in claim 1 wherein said electromagnetic radiation source is high-intensity light.

8. A fuze system as in claim 7 wherein said electromagnetic radiation source is at least one impact-initiated flash charge.

* * * * *